US008381486B1

(12) United States Patent
Lehane, Jr. et al.

(10) Patent No.: US 8,381,486 B1
(45) Date of Patent: Feb. 26, 2013

(54) UNIQUE PROFILE CEILING GRID

(75) Inventors: James J. Lehane, Jr., McHenry, IL (US); Peder J. Gulbrandsen, Aurora, IL (US); Mark R. Paulsen, Waukegan, IL (US); Abraham M. Underkofler, Waukegan, IL (US)

(73) Assignee: USG Interiors, LLC, Chicago, IL (US)

( * ) Notice: Subject to any disclaimer, the term of this patent is extended or adjusted under 35 U.S.C. 154(b) by 0 days.

(21) Appl. No.: 13/339,558

(22) Filed: Dec. 29, 2011

(51) Int. Cl.

| | |
|---|---|
| ***E04B 1/00*** | (2006.01) |
| ***E04B 2/00*** | (2006.01) |
| ***E04B 5/00*** | (2006.01) |
| ***E04B 9/00*** | (2006.01) |
| ***E04C 2/42*** | (2006.01) |
| ***E04C 5/04*** | (2006.01) |

(52) U.S. Cl. ..... 52/745.05; 52/506.07; 52/506.08; 52/664; 52/665; 52/668; 52/506.06

(58) Field of Classification Search ..... 52/506.06, 52/506.07, 506.08, 664–668
See application file for complete search history.

(56) References Cited

U.S. PATENT DOCUMENTS

| | | | | | |
|---|---|---|---|---|---|
| 3,292,332 | A | * | 12/1966 | Jahn | 52/506.07 |
| 3,979,874 | A | * | 9/1976 | Cubbler et al. | 52/664 |
| 4,161,856 | A | * | 7/1979 | Brown et al. | 52/667 |
| 4,505,083 | A | * | 3/1985 | Mieyal | 52/476 |
| 4,525,973 | A | * | 7/1985 | Vukmanic et al. | 52/667 |
| 4,989,387 | A | * | 2/1991 | Vukmanic et al. | 52/667 |
| 5,216,865 | A | * | 6/1993 | LaLonde et al. | 52/667 |
| 5,687,525 | A | * | 11/1997 | Koski et al. | 52/506.07 |
| 5,839,246 | A | * | 11/1998 | Ziegler et al. | 52/506.07 |
| 5,966,887 | A | * | 10/1999 | Mieyal | 52/506.07 |
| 6,047,511 | A | * | 4/2000 | Lehane et al. | 52/506.07 |
| 6,526,716 | B2 | * | 3/2003 | Paul | 52/506.06 |
| 6,851,238 | B2 | * | 2/2005 | Rebman | 52/506.07 |
| 7,574,838 | B2 | * | 8/2009 | Maisch et al. | 52/506.07 |
| 7,703,258 | B2 | * | 4/2010 | LaLonde et al. | 52/848 |
| 7,849,652 | B2 | * | 12/2010 | Lehane et al. | 52/506.06 |
| D641,500 | S | * | 7/2011 | Lehane et al. | D25/122 |
| D641,501 | S | * | 7/2011 | Lehane et al. | D25/122 |
| 2006/0260246 | A1 | * | 11/2006 | LaLonde et al. | 52/506.07 |
| 2009/0158684 | A1 | * | 6/2009 | Lehane et al. | 52/506.07 |
| 2010/0077687 | A1 | * | 4/2010 | Jankovec et al. | 52/506.07 |
| 2011/0088350 | A1 | * | 4/2011 | Lehane et al. | 52/745.13 |
| 2011/0131913 | A1 | * | 6/2011 | Lehane, Jr. | 52/506.1 |
| 2011/0146184 | A1 | * | 6/2011 | Lehane, Jr. | 52/506.07 |

* cited by examiner

*Primary Examiner* — Mark Wendell
(74) *Attorney, Agent, or Firm* — Pearne & Gordon LLP

(57) ABSTRACT

Suspended ceiling grid runners include a flange extending laterally to both sides, the flange forming a three dimensional face including sides visible from below a plane of the grid, opposed cross runners intersecting through runners with their ends joined by mutually interlocking end connectors extending through a slot in the through runner, the cross runner ends including end edges configured to abut a respective side of the flange of the through runner, a connector when connected to an opposite connector causes the associated end edges to resiliently locally deflect the abutted flange side to substantially eliminate any gap therebetween.

6 Claims, 2 Drawing Sheets

FIG. 1
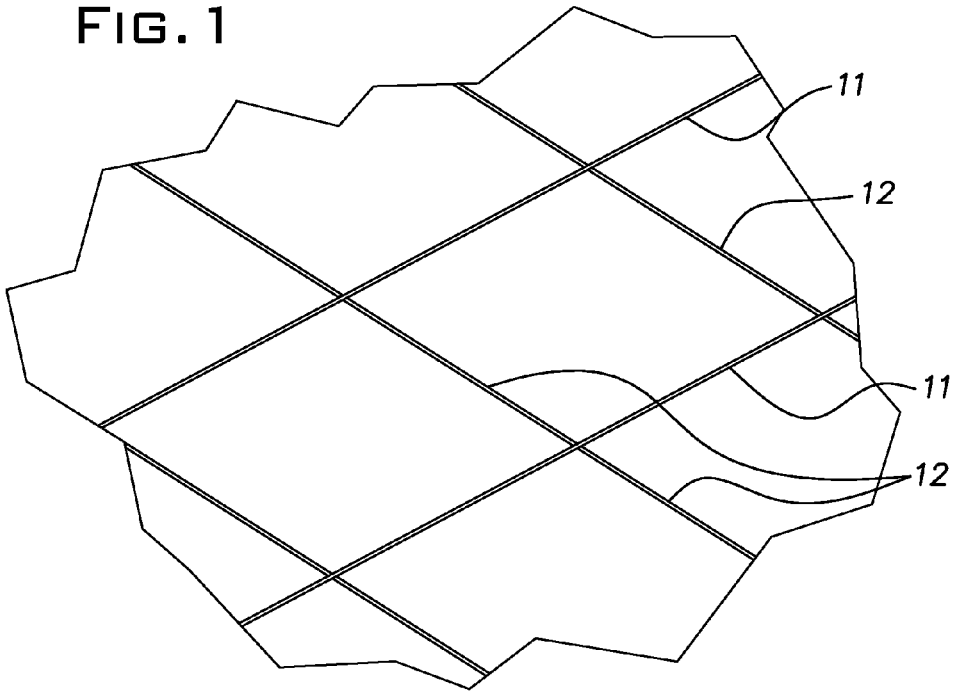
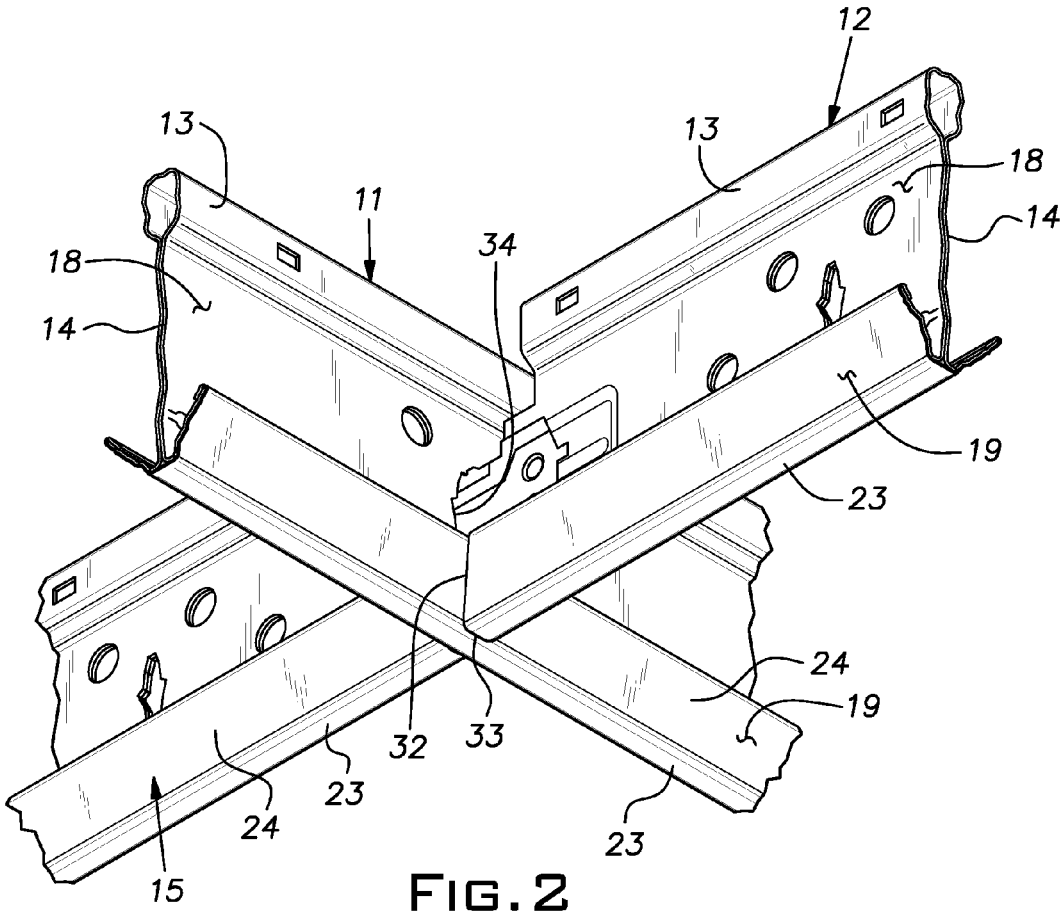
FIG. 2

UNIQUE PROFILE CEILING GRID

The invention relates to suspended ceiling components and, in particular, to a novel grid runner construction.

PRIOR ART

Conventional suspended ceilings comprise elongated metal runners arranged in the form of a rectangular grid and rectangular panels or tiles carried on the grid to close the spaces outlined by the intersecting grid elements. The ceiling is suspended from above by suspension wires. In most cases, the grid elements have faces visible from below the ceiling. Architects and interior designers continuously look for grid face designs that are more distinctive than the flat face that is most commonly used in the building industry.

When a grid face is three dimensional, it can be difficult to construct a miter or faux miter joint between intersecting grid runners that is not prone to show a visually objectionable gap or gaps at the joint.

SUMMARY OF THE INVENTION

The invention comprises suspended ceiling grid runners with a three dimensional face flange. The grid runner lends itself to forming essentially gapless faux miter joints without requiring a high skill or extra time expenditure on the part of the installer. The disclosed grid runner profile has a V-shaped face that can resiliently deflect to a limited extent to precisely conform to the cut edges of intersecting cross runners.

The longitudinal location of end connectors on the cross runners is arranged so that when a pair of opposed connectors are locked together in a slot of the through runner, they produce a slight interference fit against the face flange of the through runner they intersect. This fit slightly resiliently squeezes the V-shaped face flange laterally inward thereby eliminating any readily perceptible gap. Thus, the invention obtains a very neat faux miter joint requiring nothing more than a stab-in connection of the cross runners. No particular skill, dexterity or precision alignment is necessary, and the joint is effected in as much time as it takes to align a cross runner connector with a receiving slot in the through runner and pushing it through the slot.

BRIEF DESCRIPTION OF THE DRAWINGS

FIG. 1 is a fragmentary perspective view of a ceiling grid assembled from the grid runners of the invention as viewed from below;

FIG. 2 is a view similar to FIG. 1 on an enlarged scale;

DESCRIPTION OF THE PREFERRED EMBODIMENT

Conventionally, main runners, 12 feet long, are joined end-to-end to span the length or width of a ceiling. Cross runners of 4 foot length intersect adjacent pairs of parallel main runners at right angles. Shorter cross runners of 2 foot length can intersect pairs of adjacent parallel 4 foot cross runners. Herein, the term "through runner" will mean either a main runner or a cross runner that is intersected by a cross runner. Dimensions are to be understood to include industry metric equivalents.

In FIGS. 1 and 2, through runners in the form of main runners are indicated by the numeral 11 and cross runners are indicated by the numeral 12. As will be seen, where runners 11, 12 are joined, they construct a faux miter joint, i.e. an intersection that creates the appearance of a miter joint when viewed from below.

Figure 3:
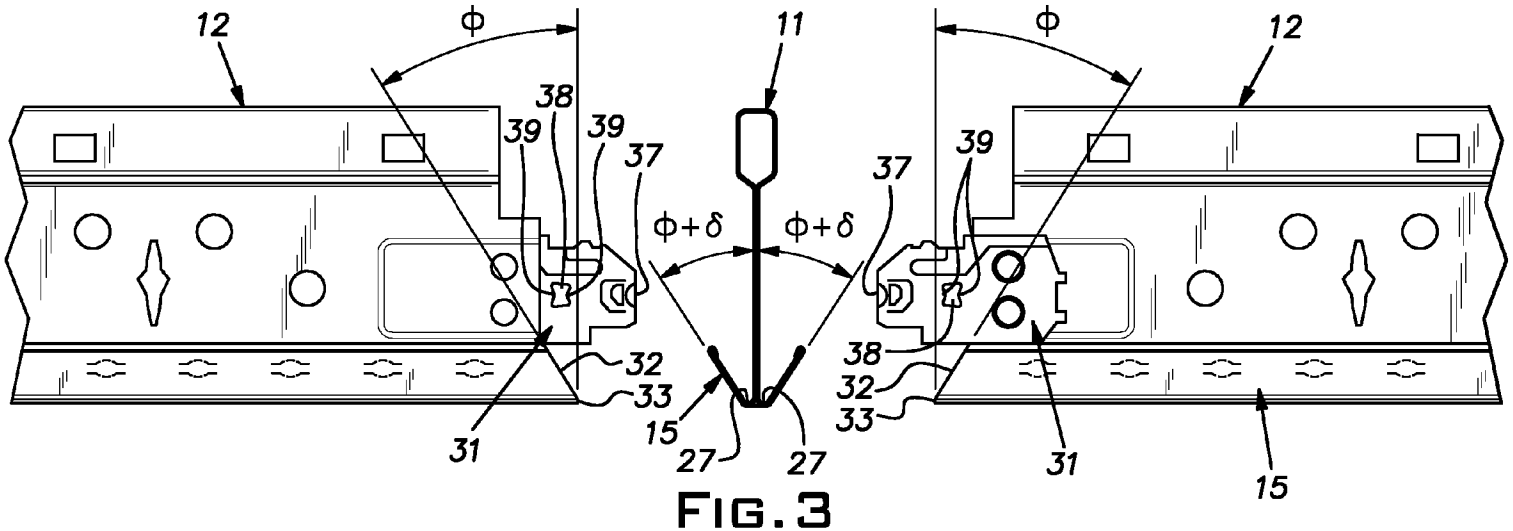
FIG. 3 is a side elevational view of a pair of opposed cross runners of the invention prior to assembly with a through runner of the invention.
Figure 4:
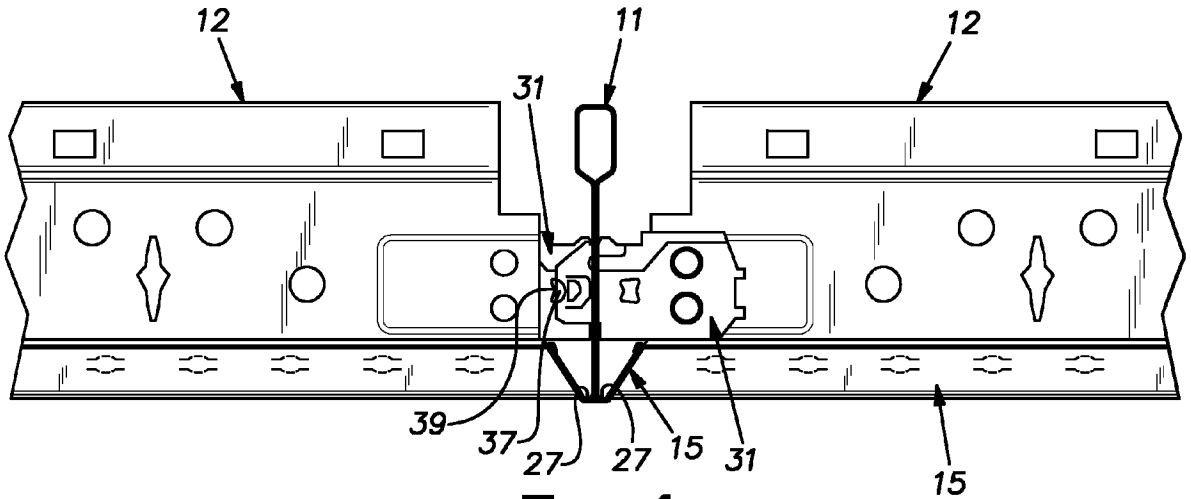
FIG. 4 is a side elevational view of the cross runners of FIG. 3 after they are joined together with the through runner.

The through and cross runners 11, 12 have the same cross section, the through runner cross section being shown most clearly in FIGS. 3 and 4. The runner cross section is symmetrical about an imaginary central vertical plane. A runner 11, 12 has an upper hollow reinforcing bulb, a double layer vertical web 14, and a V-shaped lower flange 15 at the bottom of the web 14. The runners 11, 12 are roll formed of two strips of metal which can be hot dipped galvanized steel. A main body strip 18 is folded to make the bulb 13, layers of the web 14 and upper side of the flange 15. The other strip 19 forms a visible lower side of the flange 15. The flange 15 is the face of a runner 11, 12, being visible from below a ceiling installation. The strip 19 can be painted on its lower side and its longitudinal margins can be folded over longitudinal edges of the main body 18 to permanently assemble these strips together.

The strips 18, 19 are roll formed into the illustrated and described cross sectional shape of the runners 11, 12. The main body strip 18 can have a nominal gauge thickness of 0.016" for main runners and 0.014" for cross runners while the face or flange strip 19 can be a lighter gauge of for example 0.0085". The layers of the web 14 can be locked together with integral stitching along the length of a runner 11, 12, preferably near the bottom of the web. By way of example, the grid runner can have a height of 1 13/16" and a flange width of about 9/16". The V-shaped flange 15 is preferably formed with a flat 23 of relatively narrow width. Alternatively, the flange 15 can be formed without the flat 23. The inclined sides of the flange 15 are designated with the numeral 24. The width of the bulb 13 is a conventional ¼". Aesthetically, it may be desirable for the flat bottom 23 of the flange 15 to be as narrow or, as shown, narrower than the width of the bulb 13. In such a case, prior to finish roll forming of the flange 15, the main body strip 18 can be scored at desired bend lines 27 on the side of the main body sheet or strip away from the main part of the face strip 19. The score lines are made where the desired bends 27 are to be located at the transition from the flat 23 to the inclined side portions 24. By scoring and thereby weakening the main body strip 18, the composite of the body strip 18 and face strip 19 can be formed in a roll set without the need to locally support the upper side of the flange flat 23 in an area beneath the bulb 13. This scoring technique can be similarly used in a flange configuration having essentially no flat 23.

Prior to completion of the roll forming process, the runners 11, 12 can be fitted with end connectors. FIGS. 3 and 4 show cross runners 12 assembled with end connectors 31. The illustrated end connectors 31 can be of the separate connector type shown in U.S. Pat. No. 5,761,868 or of any other suitable type either in the form of a separate piece or integrally formed in the web of the runner. End connectors for a main through runner can be of a type for example shown in U.S. Pat. No. 7,703,258 or any other suitable type, again, whether a separate piece or integrally formed with the runner stock material. A main runner can be joined with another main runner at a butt joint.

The ends of cross runners 12, including the end connectors 31 at the left and right in FIGS. 3 and 4 are identical. The end of a cross runner 12 has its web 14 and flange 15 trimmed so that the lowest parts of these elements project longitudinally beyond other parts of the runner. This trimming can be performed, for example, in a press when other details are formed and where separate connectors 31 are attached to a preform of the runner and before it is finish rolled. As shown in the side elevation of FIG. 3, cut end edges 32 of the inclined flange sides 24 are inclined away, i.e. towards the main length of the runner 12 from a cut end edge 33 of the flange flat 23. In the illustrated arrangement, these cut end edges 32, 33 are all in a common inclined plane that lies at an angle of, for example, 32 degrees off the vertical and is perpendicular to the plane of the web 14.

Through slots 34 are regularly spaced along the length of main through runners and at the center of cross runners serving as through runners.

The cross runner end connectors or clips 31 are joined by inserting them in a common through runner slot 34 where they mutually self-index by snapping and locking together in a known manner. The illustrated end connectors 31 are locked together when a forward vertical strap or bar 37 snaps into a pocket 38 formed by opposing projections 39 on the opposite connector. The relative positions of the cut end edges 32, 33 and a respective connector 31 of each cross runner 12 are specially arranged. The arrangement causes the cross runner end edges 32 to produce a small resilient local deflection in bending of the through runner flange side 24 which they abut. As a result, at the intersection of a cross runner 12 at each side of a through runner 11, the through runner flange side 24 closely fits against the end edges of the cross runner. This resiliently stress condition of the through runner assures that a faux miter joint between a through and cross runner is made without a visible gap.

The sides 24 of the through runner V-flange 15 are formed at an angle off the vertical that is preferably slightly greater, e.g. 0.5 to 3 degrees, than the angle of the plane of the cut end edges 32, 33 of the flange 15 of a cross runner. For example, where the angle of the plane of the cut end edges is 32 degrees, the flange sides 24 can be roll formed into planes 31 degrees off the vertical, i.e. the plane of the web 14. Ideally, the planes of the cross runner flange sides 24 have the same angular orientation off the vertical as do the flange sides of the through runners.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A suspended ceiling grid comprising through runners and cross runners intersecting the through runners at right angles, the grid runners being roll formed sheet metal with a cross section that includes an upper hollow reinforcing bulb, a web extending below the bulb and a flange extending laterally on both sides of the web, the flange forming a three dimensional face including sides that extend with a vertical component and collectively represent a majority of the area of the flange visible from below the plane of the grid, opposed cross runners intersecting the through runners at locations along the through runners, the opposed cross runners at each location having ends joined by mutually interlocking end connectors extending through a slot in the web of the through runner, the cross runner ends including end edges on their flanges, the end edges being configured to abut a respective side of the flange of the through runner, a connector being arranged on the cross runner relative to the end edges of the associated flange such that when it is connected to an opposite connector, it causes the associated end edges to resiliently locally deflect the abutted flange side to substantially eliminate any gap therebetween.

2. A suspended ceiling grid as set forth in claim 1, wherein said flange sides are planar.

3. A suspended ceiling grid as set forth in claim 1, wherein said flange in cross section is V-shaped.

4. A suspended ceiling grid as set forth in claim 3, wherein said flange has a flat bottom.

5. A suspended ceiling grid as set forth in claim 1, wherein said cross runner end edges underlie the respective side of a through runner flange.

6. A method of constructing a faux miter joint in a ceiling grid comprising supplying through runners and cross runners having a cross section that includes an upper hollow reinforcing bulb, a vertical web and a lower three dimensional flange with side faces forming a major fraction of a total area of the flange visible from below the grid, the flange being laterally resiliently deflectable by a bending action displacing the side faces, the cross runners being provided with end connectors that interlock with identical end connectors when assembled through a slot in a through runner web from opposite sides, proportioning the end connectors in relation to the end edges of the flanges of the cross runners so that the flange end edges resiliently deflect corresponding sides of the through runner flange laterally inward when the connectors interlock whereby gaps between the flange ends and flange sides are substantially eliminated.

* * * * *